US006256827B1

(12) United States Patent
Vanderlinden

(10) Patent No.: US 6,256,827 B1
(45) Date of Patent: Jul. 10, 2001

(54) UTILITY TYPE SURFACE CLEANING VEHICLE HAVING IMPROVED GUTTER BROOM PLACEMENT

(76) Inventor: Roger P. Vanderlinden, 73 Sherman Ave. South, Hamilton, Ont (CA), L8M 2P8

( * ) Notice: Subject to any disclaimer, the term of this patent is extended or adjusted under 35 U.S.C. 154(b) by 0 days.

(21) Appl. No.: 09/371,528

(22) Filed: Aug. 10, 1999

(51) Int. Cl.[7] ..... E01H 1/04; E01H 1/05
(52) U.S. Cl. ..... 15/87; 15/84; 15/340.4
(58) Field of Search ..... 15/78, 82–86, 15/87, 340.1, 340.3, 340.4

(56) References Cited

U.S. PATENT DOCUMENTS 1,510,880 * 10/1924 Aitken ..... 15/87
3,011,193 * 12/1961 Schmidt et al. ..... 15/87
3,028,616 * 4/1962 Breneman ..... 15/87
3,184,777 * 5/1965 Norden ..... 15/340.3
3,203,022 * 8/1965 Clarke ..... 15/340.1
3,639,936 * 2/1972 Ashton ..... 15/87
3,676,891 * 7/1972 Murray et al. ..... 15/340.1
3,790,981 * 2/1974 Young ..... 15/87
5,005,597 * 4/1991 Popelier et al. ..... 15/340.1
5,010,620 * 4/1991 Young ..... 15/340.3
5,218,737 * 6/1993 Dansby et al. ..... 15/340.1
5,317,783 * 6/1994 Williamson ..... 15/340.1

* cited by examiner

*Primary Examiner*—Terrence R. Till

(57) ABSTRACT

A utility type surface cleaning vehicle comprising a unitary frame utility type tractor defining a longitudinal axis and having left and right driven rear wheels and at least one steerable front wheel and a trailer connecting mechanism. A debris hopper is removably connectable to the utility type tractor via the trailer connecting mechanism. A surface cleaning apparatus is operatively connectable to the utility type tractor and connected in debris depositing relation via a debris transfer means to the debris hopper. At least one gutter broom is included, with each gutter broom being mounted on the utility type tractor for rotation about a respective substantially vertical gutter broom axis disposed rearwardly of the foremost portion of said at least one steerable front wheel and disposed forwardly of said left and right driven rear wheels.

24 Claims, 8 Drawing Sheets

UTILITY TYPE SURFACE CLEANING VEHICLE HAVING IMPROVED GUTTER BROOM PLACEMENT

FIELD OF THE INVENTION

The present invention relates to surface cleaning vehicles and more particularly to utility type surface cleaning vehicles.

BACKGROUND OF THE INVENTION

The removal of dirt and debris from streets, parking lots, airport runways, factory floors, and other similar paved surfaces, through the use of various types of street cleaning vehicles or factory sweeping vehicles, as may be the case, has been known for many years. For the sake of brevity, clarity and simplicity, such vehicles will be generally referred to in this document as surface cleaning vehicles. Conventional surface cleaning vehicles comprise a surface cleaning apparatus, such as a sweeping broom, a recirculating air type head, or a vacuum air head. Most commonly, such surface cleaning apparata are permanently mounted on a truck frame. Alternatively, such surface cleaning apparata are removably connected to a tractor, either securely attached to the three point hitch for direct turning with the tractor, or connected in freely pivoting relation to the towbar. The tractors being referred to are typically conventional unitary frame—or in other words are non-articulated—utility type tractors, manufactured by companies such as Ford, John Deere, Massey Ferguson, among others. Such conventional tractors are powered by an internal combustion engine that typically can produce about sixty-five to seventy horsepower.

Utility type surface cleaning vehicles have inherent cost and overall operational advantages over truck type surface cleaning vehicles in that the tractors can additionally be used to perform other tasks, such as ploughing snow, cutting grass, and so on. However, in spite of these advantages that are extremely important to the owners or operators of such vehicles, utility type surface cleaning vehicles are much less popular than truck type surface cleaning vehicles largely due to their lack of overall performance in prior art surface cleaning vehicles.

one significant performance related problem with utility type surface cleaning vehicles is that they tend to leave portions of a surface unswept by the gutter brooms as the vehicle tracks around corners, due to the improper geometric relationship between the gutter brooms, the front steerable wheels of the tractor and the surface cleaning apparatus—or in other words due to the placement of gutter brooms significantly ahead of the front wheels of the tractor. As can be seen in FIG. 1 (Prior Art), the tractor 10 has two gutter brooms 12 that are disposed forwardly of the front end of the tractor 10. As the tractor 10 tracks around the corner, it is necessary for the operator to look in a forward direction in order to watch the road in general and to view the gutter brooms 12 to ensure that the gutter brooms 12 are disposed in contacting relation with the curb 16. It is also necessary for the operator to look in a sideward direction to view the curb 16 and the rear wheels 14, in order to help maintain a proper steering relation with the curb 16. Further, it is also necessary for the operator to look in a rearward direction to ensure that no debris has been missed. With such prior art utility type surface cleaning vehicles, it is difficult to watch in each of these three stated directions frequently enough to have the gutter brooms 12 maintain contact with the curb 16 more than about half of the time, thus causing a significant amount of debris close to the curb 16 to be missed by the gutter brooms 12, which is unacceptable.

Another serious drawback with utility type surface cleaning vehicles is that the surface cleaning apparatus, the debris hopper, and the debris transfer apparatus are all positioned behind the tractor, and the gutter brooms are positioned in front of the tractor. Accordingly, the overall vehicle is quite long, which means that is difficult for such utility type surface cleaning vehicles to safely and properly manoeuver around objects on a city street, to accurately turn corners in a city block while maintaining one gutter broom properly against a curb, and so on.

Further, it is extremely difficult, to turn around such a utility type surface cleaning vehicle in a dead-end street, which is unacceptable.

Other utility type surface cleaning vehicles have the gutter brooms and the hopper located behind the tractor portion. Accordingly, it is necessary to look in a rearward direction to view the gutter brooms and the curb, which is very difficult, and even dangerous, considering it is necessary to look in a forward direction when driving.

It is therefore very important that utility type surface cleaning vehicles are as short as reasonably possible.

It is an object of the present invention to provide a utility type surface cleaning vehicle having a proper geometric relationship between the gutter brooms, the front steerable wheels of the tractor and the surface cleaning apparatus.

It is an object of the present invention to provide a utility type surface cleaning vehicle that has at least one gutter broom mounted thereon disposed rearwardly of said front limit of extent of the steerable front wheels.

It is still another object of the present invention to provide a utility type surface cleaning vehicle that is less lengthy than prior art utility type surface cleaning vehicles.

SUMMARY OF THE INVENTION

In accordance with one aspect of the present invention, there is disclosed a novel utility type surface cleaning vehicle comprising a unitary frame utility type tractor defining a longitudinal axis and having left and right driven rear wheels and at least one steerable front wheel and trailer connecting means. A debris hopper is removably connectable to the utility type tractor via the trailer connecting means. A surface cleaning apparatus is operatively connectable to the utility type tractor and connected in debris depositing relation via a debris transfer means to the debris hopper. At least one gutter broom is included, with each gutter broom being mounted on the utility type tractor for rotation about a respective substantially vertical gutter broom axis disposed rearwardly of the foremost portion of said at least one steerable front wheel and disposed forwardly of said left and right driven rear wheels.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the utility type surface cleaning vehicle, according to the present invention, as to its structure, organization, use and method of operation, together with further objectives and advantages thereof, will be better understood from the following drawings in which prior art, a presently preferred embodiment and an alternative embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
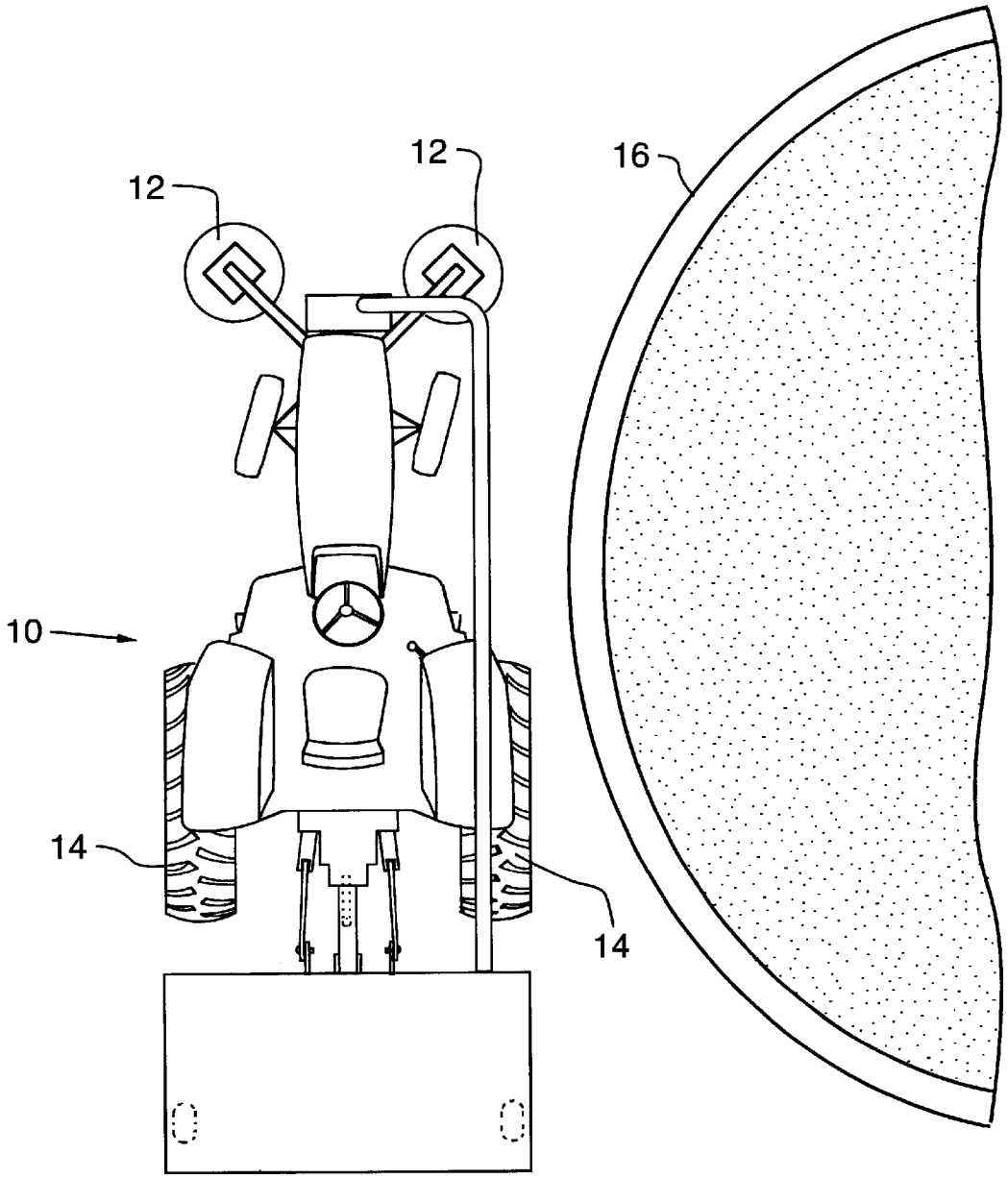
FIG.1 (PRIOR ART)
FIG. 1 is a top plan view of a prior art utility type surface cleaning vehicle cleaning a surface.

Reference will now be made to FIGS. 2 through 5 of the drawings, which show a preferred embodiment and an alternative embodiment of the utility type surface cleaning vehicle according to the present invention.

Reference will first be made to FIG. 2 and FIGS. 3A through 3G, which show the preferred embodiment utility type surface cleaning vehicle, as indicated by the general reference numeral 20. The utility type surface cleaning vehicle 20 includes a unitary frame—or in other words non-articulating—utility type tractor, as indicated by the general reference numeral 30, having a frame 32 defining a longitudinal axis "A". An internal combustion engine 34 that produces about sixty-five to seventy horsepower is mounted within an engine housing 36 forming part of the frame 32 of the unitary frame utility type tractor 30. A manual transmission 40 is connected in driven relation to the internal combustion engine 34, with the robust housing 42 of the manual transmission 40 forming part of the frame 32 of the tractor 30. A rear differential 44 is connected in driven relation to the manual transmission 40 and also forms part of the frame 32 of the tractor 30. Alternatively, the unitary frame utility type tractor 30 could be hydraulically driven. A power take-off mechanism 45 is operatively mounted on the utility type tractor 30. More specifically, the power take-off mechanism 45 is connected in driven relation to the internal combustion engine 34. Trailer connecting means comprising a three-point hitch 46 and/or a towbar 48 are mounted on the frame 32 of the tractor 30.

A trailing unit, as indicated by the general reference numeral 50, is removably connectable to the surface cleaning vehicle 20 in towed relation thereto, via the three point hitch 46. In this case, the weight of the trailing unit 50 is borne partly, or even mostly, by the frame 32, and partially by wheels 49. Also, the trailing unit 50 would turn with the tractor 30, with the back end 51 of the trailing unit 50 extending outwardly in the opposite direction to the direction of turn of the tractor 30. Alternatively, the towbar 48 could be used, but with any unit towed via the towbar 48, the weight of the trailing unit 50 is borne mostly by wheel means mounted on the trailing unit 50. Also, the trailing unit 50 would be towed in freely pivotal relation about the hitch portion 47 of the towbar 48, In either case, the trailing unit 50 includes a surface cleaning apparatus, specifically a re-circulating type pick-up head 52, that is thereby operatively connectable to the unitary frame utility type tractor 30. The surface cleaning apparatus comprises a recirculating air type pick-up head 52 that receives a stream of air from a main fan (not viewable) through an air supply hose 56. The recirculating air type pick-up head 52 is connected in debris depositing relation via a debris transfer means comprising a suction hose 62 to a debris hopper 58. The debris hopper 58 thereby receive debris from the recirculating air type pick-up head 52. In the preferred embodiment as illustrated, the debris hopper 58 forms most of the trailing unit 50, and is therefore removably connectable to the utility type tractor 30. Further, the removably mountable debris hopper 58 and the removably mountable recirculating air type pick-up head 52 are disposed rearwardly of the unitary frame utility type tractor 30.

The utility type surface cleaning vehicle 20 comprises at least one steerable front wheel, as indicated by the general reference numeral 70, and in the preferred embodiment as illustrated, comprises a left steerable front wheel 72 and a right steerable front wheel 74. The left 72 and right 74 steerable front wheels are mounted on the frame 32 for rotation about a substantially horizontal front wheel pivot axis "PF", are steerable by means of the tractor's steering wheel 21 such that the front wheel pivot axis "PF" moves angularly with respect to a substantially vertical steering axis "S", between an extreme left angular orientation. Analogously, the tractor may have a standard fixed front axle with left and right wheels mounted at the opposite ends thereof for co-operating turning about spaced apart axes.

Left 76 and right 78 driven rear wheels are mounted on the frame 32 at the rear differential 44 for selectively driven rotation about a substantially horizontal rear wheel pivot axis "PR", as powered by the internal combustion engine 34.

Such unitary frame utility type tractors 30 are typically used in agricultural applications and on construction sites, for low speed carrying, pushing, or pulling of implements. For the purpose of this document, the terms "tractor" and "tractors" do not include truck-type tractors used to pull transport trailers and do not include trucks.

Figure 2:
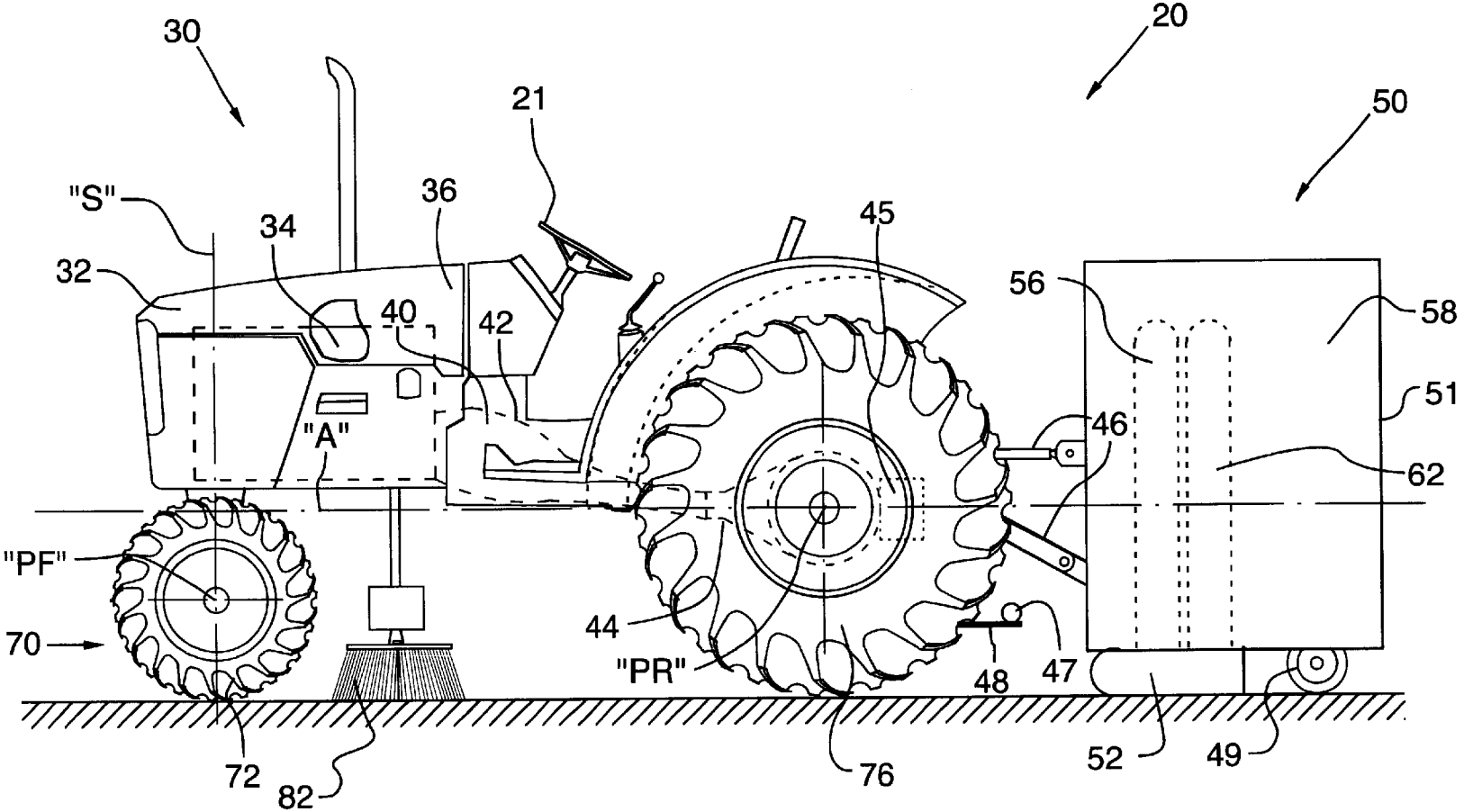
FIG. 2 is a side elevational view of a preferred embodiment utility type surface cleaning vehicle according to the present invention.

At least one gutter broom, as indicated by the general reference numeral 80, is mounted on the surface cleaning vehicle. Tn the preferred embodiment as illustrated, left 82 and right 84 gutter brooms each mounted on the surface cleaning vehicle 20 for rotation about substantially vertical left "L" and right "R" gutter broom axes, respectively. Preferably, the left 82 and right 84 gutter brooms are disc-type brushes and are selectively moveable between a lowered surface cleaning position, as can be seen in FIG. 2, and a raised position, which is not specifically illustrated. The left 82 and right 84 gutter brooms are mounted such that the left "L" and right "R" gutter broom axes are disposed rearwardly of the foremost of the left 72 and right 74 steerable front wheels, when the front wheels 72, 74 are straight, as is illustrated in solid lining in FIGS. 3A through 3G. Further, the left 82 and right 84 gutter brooms are mounted forwardly of the left 76 and right 78 driven rear wheels so as to not interfere with the driven rear wheels 76, 78.

Figure 3A:
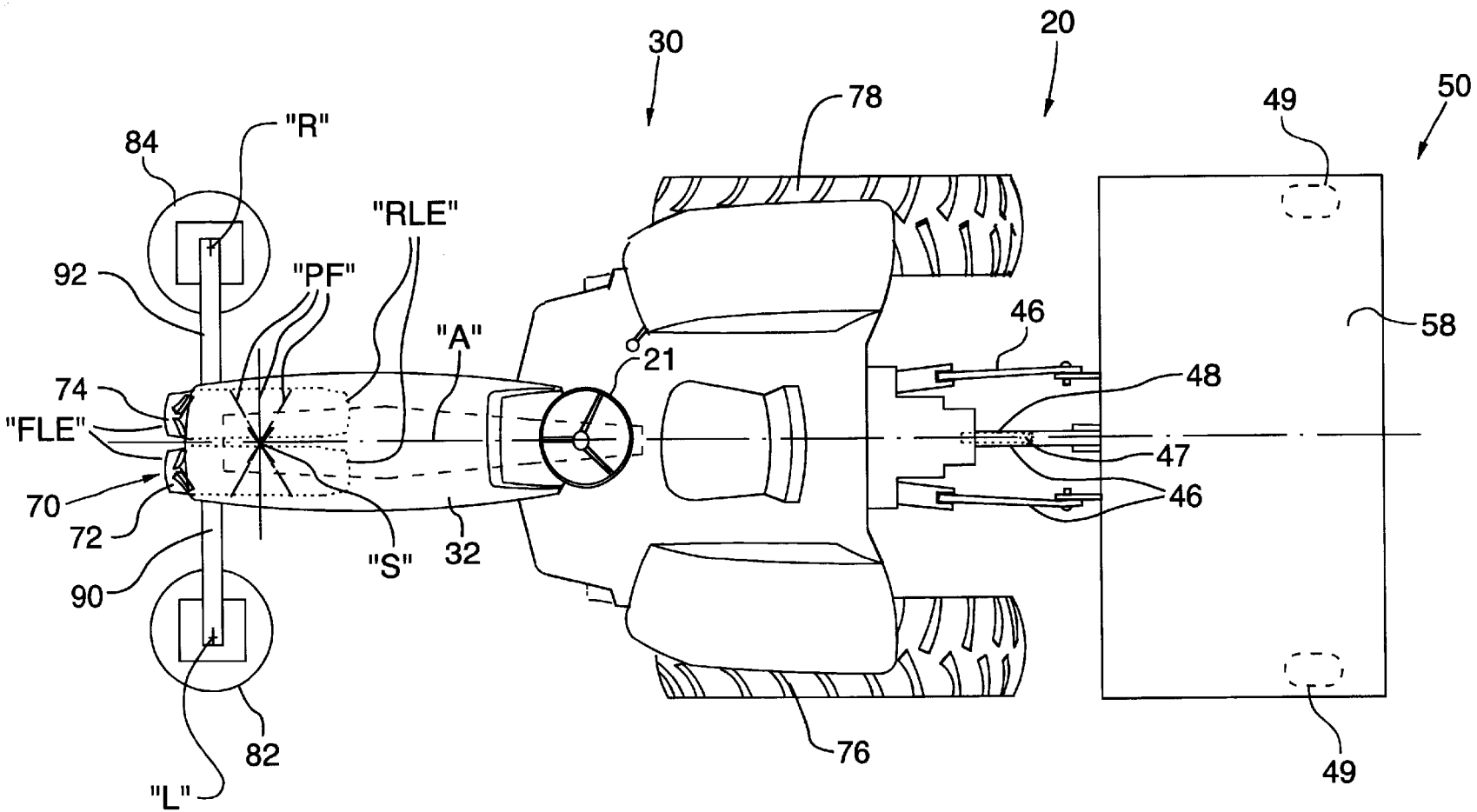
FIG. 3A is a top plan view of the preferred embodiment utility type surface cleaning vehicle of FIG. 2, with the left and right gutter brooms in a foremost position wherein the left and right gutter broom axes are disposed rearwardly of the front limit of extent of the left and right steerable front wheels.
Figure 3B:
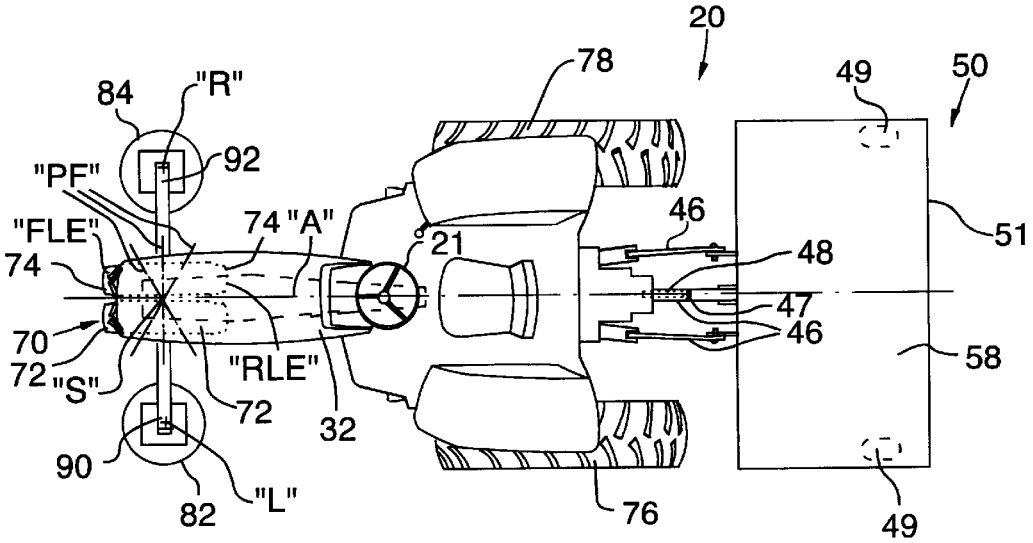
FIG. 3B is a top plan view similar to FIG. 3A, but with the left and right gutter brooms disposed entirely rearwardly of the front limit of extent of the left and right steerable front wheels.
Figure 3C:
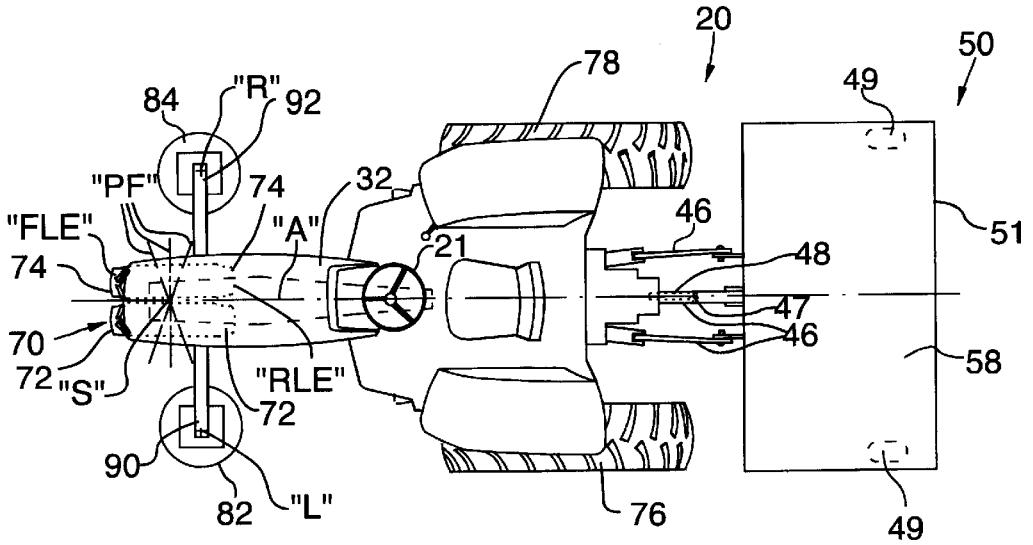
FIG. 3C is a top plan view similar to FIG. 3B, but with the left and right gutter broom axes disposed rearwardly of the front wheel pivot axis.
Figure 3D:
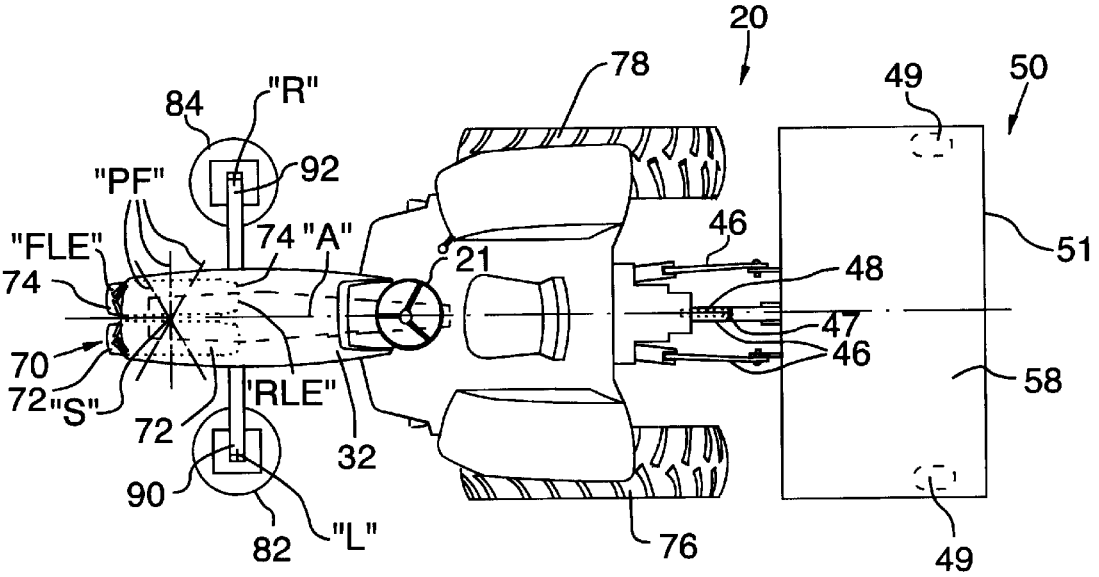
FIG. 3D is a top plan view similar to FIG. 3C, but with the left and right gutter brooms disposed entirely rearwardly of the front wheel pivot axis.
Figure 3E:
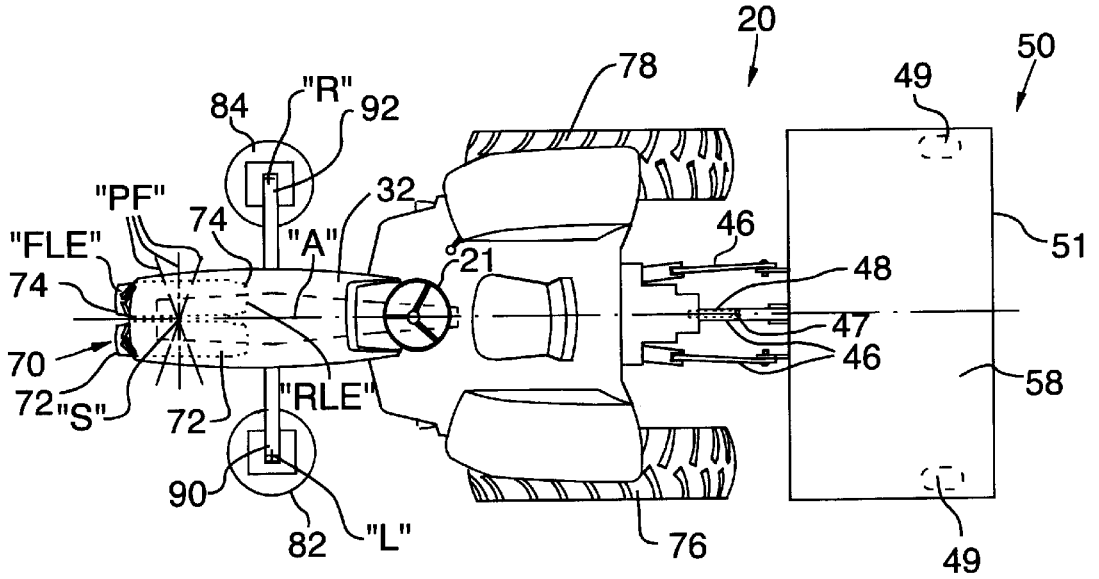
FIG. 3E is a top plan view similar to FIG. 3D, but with the left and right gutter broom axes disposed rearwardly of the rear limit of extent of the left and right steerable front wheels.
Figure 3F:
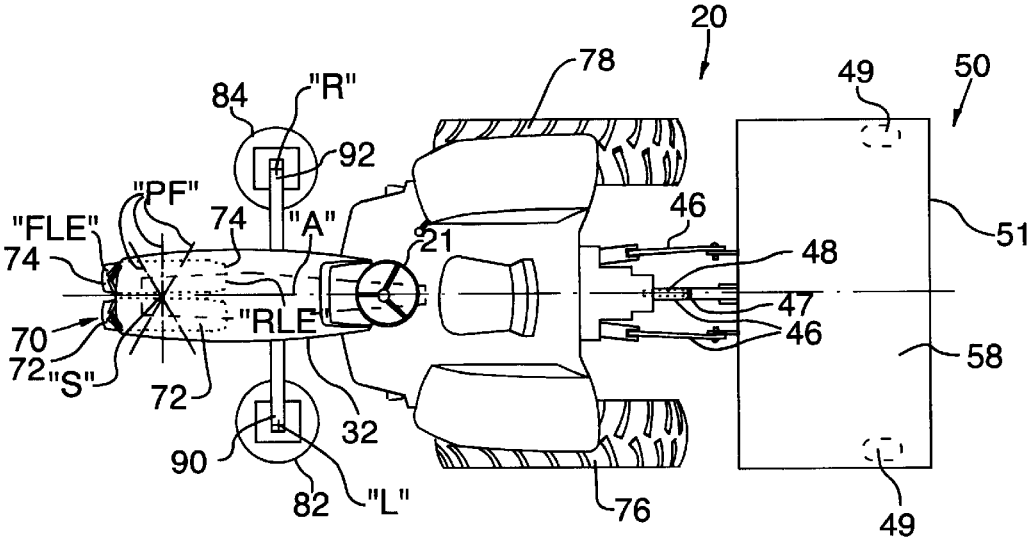
FIG. 3F is a top plan view similar to FIG. 3E, but with the left and right gutter brooms disposed entirely rearwardly of the rear limit of extent of the left and right steerable front wheels.
Figure 3G:
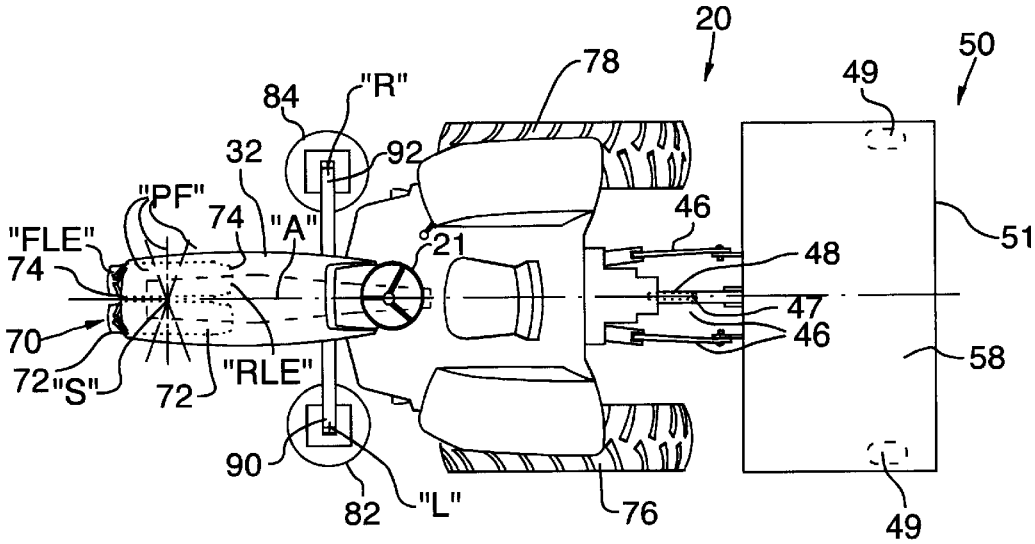
FIG. 3G is a top plan view similar to FIG. 3F, but with the left and right gutter brooms in a rearmost position, as shown in FIG. 2, with the left and right gutter brooms still disposed entirely rearwardly of the rear limit of extent of the left and right steerable front wheels.

In the preferred embodiment, as illustrated, the left 82 and right 84 gutter brooms are each mounted on the surface cleaning vehicle 20 via left 90 and right 92 mounting arms pivotally mounted to the frame 32 of the tractor 30, so as to be selectively movable between a foremost position, as is shown in FIG. 3A, and a rearmost position, as is shown in FIG. 3G. In the foremost position, as can be seen in FIG. 3A, the left "L" and right "R" gutter broom axes are disposed rearwardly of the foremost portion of the left 72 and right 74 steerable front wheels, when the front wheel 72, 74 are straight. In the rearmost position, as can be seen in FIG. 3G, the left 82 and right 84 gutter brooms are disposed entirely rearwardly of the rear limit of extent of the left 72 and right 74 steerable front wheels when the front wheels 72, 74 are straight, and are also disposed immediately ahead of the driven rear wheels 76, 78.

The left 82 and right 84 gutter brooms are also selectively movable to other positions. As can be seen in FIG. 3B, the left 82 and right 84 gutter brooms are disposed entirely rearwardly of the foremost portion of the left 72 and right 74 steerable front wheels. As can be seen in FIG. 3C, the left 82 and right 84 gutter brooms axes are disposed rearwardly of the front wheel pivot axis. As can be seen in FIG. 3D, the left 82 and right 84 gutter brooms are disposed entirely rearwardly of the front wheel pivot axis. As can be seen in FIG. 3E, the left "L" and right "P" gutter broom axes are disposed rearwardly of the left 72 and right 74 steerable front wheels. As can be seen in FIG. 3F, the left 82 and right 84 gutter brooms are disposed entirely rearwardly of the left 72 and right 74 steerable front wheels, and about half way between the left 72 and right 74 steerable front wheels and the driven rear wheels 76,78. Finally, as can be seen in FIG. 3G, the left 82 and right 84 gutter brooms are disposed entirely rearwardly of the rear limit of extent of the left 72 and right 74 steerable front wheels, immediately ahead of the driven rear wheels 76, 78, and are in their rearmost position, as discussed previously.

All comparative positioning of the left 82 and right 84 gutter brooms and the left "L" and right "R" gutter broom axes with respect to the left 72 and right 74 steerable front wheels, is made when the front wheels 72, 74 are straight, such that the surface cleaning vehicle 20 would travel in a straight path.

Figure 4:
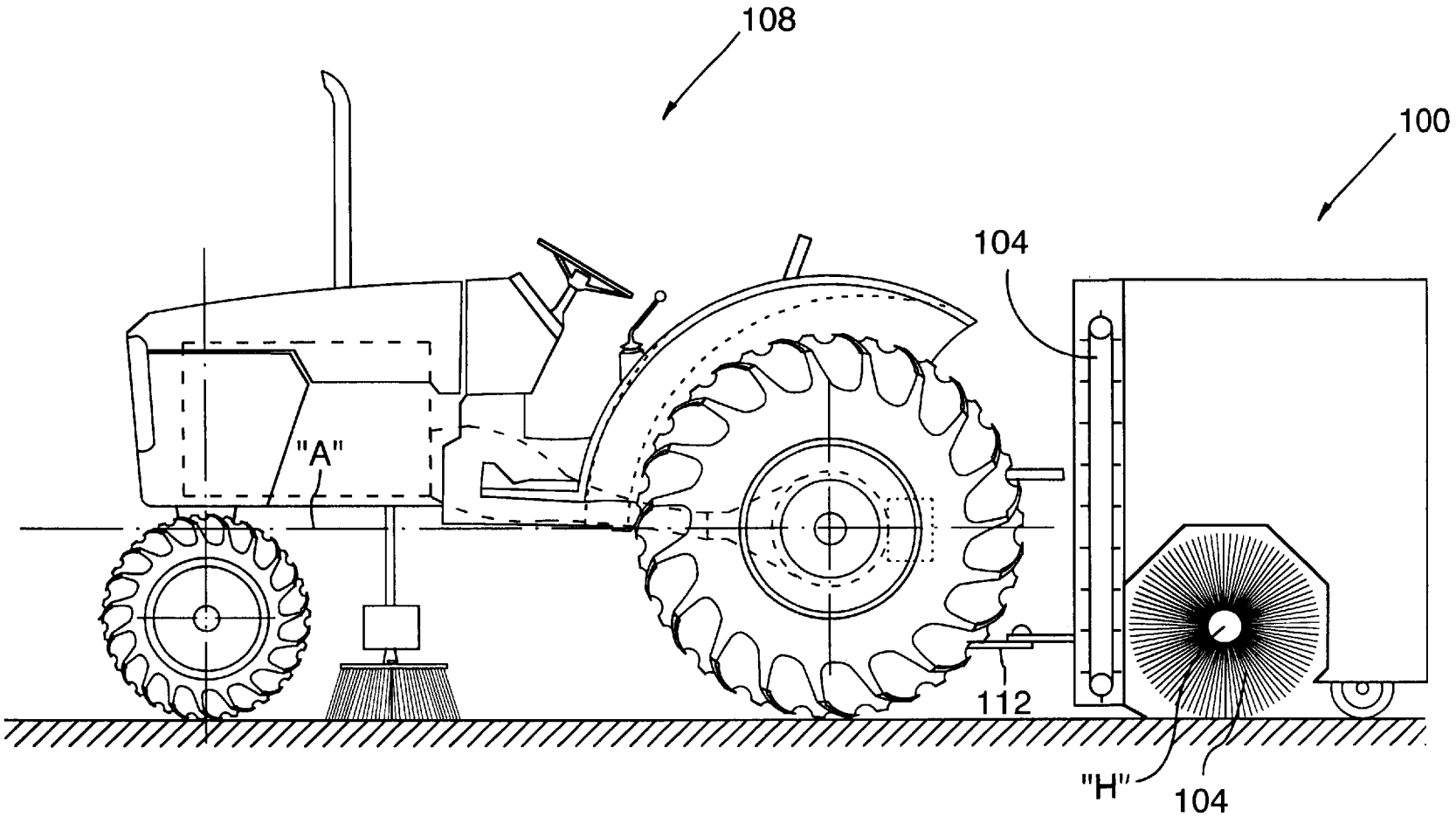
FIG. 4 is a top plan view of an alternative embodiment utility type surface cleaning vehicle according to the present invention; and, FIG. 5 is a top plan view similar to FIG. 1, but of the preferred embodiment utility type surface cleaning vehicle of FIG. 2, cleaning a surface.

In an alternative embodiment of the utility type surface cleaning vehicle 100 according to the present invention, as illustrated in FIG. 4, the removably mountable surface cleaning apparatus comprises gutter brooms 82 (only the left gutter broom 82 is visible) operatively mounted on the tractor 108 and a cylindrically-shaped elongate rotating sweeping broom 102 operatively mounted on a debris hopper 106, for rotation about a substantially horizontal axis "H" oriented transversely to the main longitudinal axis "A". The debris hopper 106 is in turn connected to the tractor 106 via the three point hitch 112. The removably mountable debris transfer means comprises a mechanical debris elevator 104 that receives debris from the rotating sweeping broom 102 and deposits it in the debris hopper 106.

Figure 5:
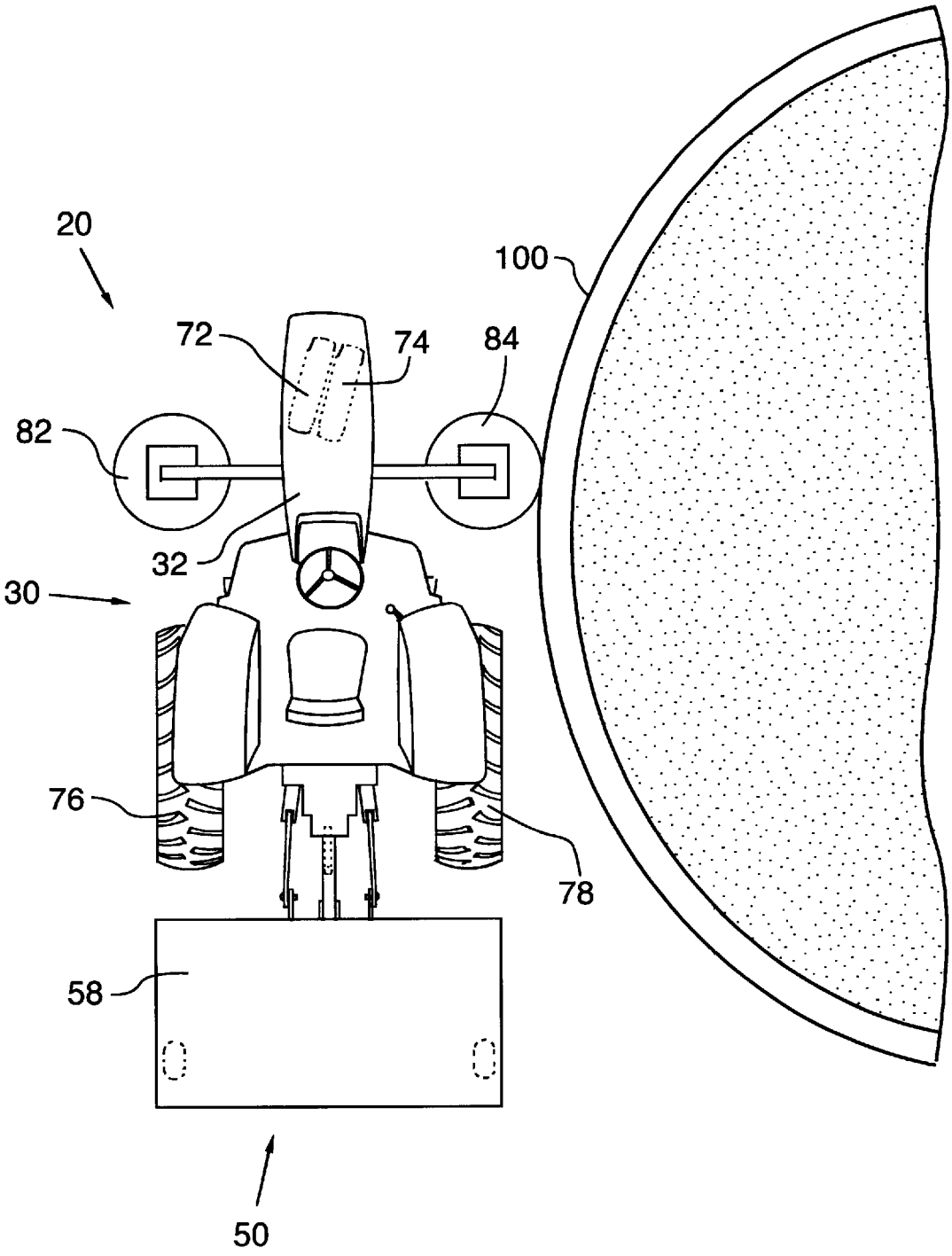

As can be seen in FIG. 5, with the utility type surface cleaning vehicle 20 according to the present invention, the left 82 and right 84 gutter brooms are left 82 and right 84 gutter brooms are readily viewable while watching the curb 100. Accordingly, due to the placement of the left 62 and right 84 gutter brooms, it is relatively easy to steer the utility type surface cleaning vehicle 20 such that the right gutter broom 84 (or the left gutter broom 82, if appropriate is maintained in contacting relation with the curb 100. Further, it is easy to steer the surface cleaning vehicle 20 properly alongside the curb 100 without having the rear wheel 78 climb onto the curb 100.

other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

I claim:

1. A utility type surface cleaning vehicle comprising:

a unitary frame utility type tractor defining a generally centrally disposed longitudinal axis and having left and right driven rear wheels and at least one steerable front wheel;

a debris hopper removably connected to said utility type tractor;

at least one gutter broom, each gutter broom mounted on said utility type tractor for rotation about a respective gutter broom axis disposed rearwardly of the foremost portion of said at least one steerable front wheel and disposed forwardly of said left and right driven rear wheels and oriented such that said at least one gutter broom is in partial contact with a surface being cleaned, so as to move debris on said surface being cleaned towards said generally centrally disposed longitudinal axis to thereby form a generally central trail of debris; and, a surface cleaning apparatus mounted on said utility type tractor rearwardly of said at least one gutter broom in transversely extending relation across said generally centrally disposed longitudinal axis for removing said generally central trail of debris from said surface being cleaned, and operatively connected in debris depositing relation via a debris transfer means to said debris hopper.

2. The utility type surface cleaning vehicle of claim 1, wherein said unitary gutter broom is disposed entirely rearwardly of said foremost portion of said at least one steerable front wheel.

3. The utility type surface cleaning vehicle of claim 1, wherein said gutter broom axis is disposed rearwardly of said front wheel pivot axis.

4. The utility type surface cleaning vehicle of claim 1, wherein said unitary gutter broom is disposed entirely rearwardly of said front wheel pivot axis.

5. The utility type surface cleaning vehicle of claim 1, wherein said gutter broom axis is disposed rearwardly of said at least one steerable front wheel.

6. The utility type surface cleaning vehicle of claim 1, wherein said unitary gutter broom is disposed entirely rearwardly of said at least one steerable front wheel.

7. The utility type surface cleaning vehicle of claim 1, wherein said at least one gutter broom comprises a single gutter broom mounted on said surface cleaning vehicle for rotation about a gutter broom axis.

8. The utility type surface cleaning vehicle of claim 7, wherein said single gutter broom is disposed entirely rearwardly of the foremost portion of said at least one steerable front wheel.

9. The utility type surface cleaning vehicle of claim 7, wherein said gutter broom axis is disposed rearwardly of said front wheel pivot axis.

10. The utility type surface cleaning vehicle of claim 7, wherein said single gutter broom is disposed entirely rearwardly of said front wheel pivot axis.

11. The utility type surface cleaning vehicle of claim 7, wherein said gutter broom axis is disposed rearwardly of said at least one steerable front wheel.

12. The utility type surface cleaning vehicle of claim 7, wherein said gutter broom is disposed entirely rearwardly of said at least one steerable front wheel.

13. The utility type surface cleaning vehicle of claim 1, wherein said at least one gutter broom comprises left and right gutter brooms each mounted on said surface cleaning vehicle for rotation about left and right gutter broom axes, respectively.

14. The utility type surface cleaning vehicle of claim 13, wherein said left and right gutter brooms are disposed entirely rearwardly of the foremost portion of said at least one steerable front wheel.

15. The utility type surface cleaning vehicle of claim 13, wherein said left and right gutter broom axes are disposed rearwardly of said front wheel pivot axis.

16. The utility type surface cleaning vehicle of claim 13, wherein said left and right gutter brooms are disposed entirely rearwardly of said front wheel pivot axis.

17. The utility type surface cleaning vehicle of claim 13, wherein said left and right gutter broom axes are disposed rearwardly of said at least one steerable front wheel.

18. The utility type surface cleaning vehicle of claim 13, wherein said left and right gutter brooms are disposed entirely rearwardly of said at least one steerable front wheel.

19. The utility type surface cleaning vehicle of claim 1, wherein said surface cleaning apparatus comprises a cylindrically-shaped elongate rotating sweeping broom mounted on said surface cleaning vehicle for rotation about a substantially horizontal axis.

20. The utility type surface cleaning vehicle of claim 1, wherein said debris hopper is disposed rearwardly of said utility type tractor.

21. The utility type surface cleaning vehicle of claim 1, wherein said surface cleaning apparatus is disposed rearwardly of said utility type tractor.

22. The utility type surface cleaning vehicle of claim 1, wherein said surface cleaning apparatus is mounted on said utility type tractor in selectively removable relation.

23. The utility type surface cleaning vehicle of claim 1, wherein said debris hopper is removably connected in towed relation to said utility type tractor.

24. The utility type surface cleaning vehicle of claim 1, wherein said debris hopper is removable connected in weight-borne relation to said utility type tractor.

* * * * *